US008836459B1

(12) United States Patent
Hsu et al.

(10) Patent No.: US 8,836,459 B1
(45) Date of Patent: Sep. 16, 2014

(54) POWER MODULE

(71) Applicant: Chicony Power Technology Co., Ltd., New Taipei (TW)

(72) Inventors: Ming-Yen Hsu, New Taipei (TW); Chao-Jui Huang, New Taipei (TW); Yu-Jen Lai, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 13/936,003

(22) Filed: Jul. 5, 2013

(51) Int. Cl.

| | |
|---|---|
| ***H01F 27/06*** | (2006.01) |
| ***H01F 27/02*** | (2006.01) |
| ***H01F 27/29*** | (2006.01) |
| ***H01F 27/30*** | (2006.01) |
| ***H01F 27/24*** | (2006.01) |
| ***H01F 27/04*** | (2006.01) |

(52) U.S. Cl.
CPC ..... *H01F 27/04* (2013.01)
USPC ..... 336/65; 336/82; 336/192; 336/197; 336/212

(58) Field of Classification Search
USPC ..... 336/65, 82, 192, 197, 212
See application file for complete search history.

(56) References Cited

U.S. PATENT DOCUMENTS

| | | | | |
|---|---|---|---|---|
| 3,859,614 | A * | 1/1975 | Reithmaier | 336/83 |
| 4,656,450 | A * | 4/1987 | Jarosz et al. | 336/83 |
| 6,392,519 | B1 * | 5/2002 | Ronning | 336/90 |
| 6,922,130 | B2 * | 7/2005 | Okamoto | 336/208 |
| 7,567,161 | B2 * | 7/2009 | Monma | 336/83 |
| 8,698,586 | B2 * | 4/2014 | Park et al. | 336/192 |

* cited by examiner

*Primary Examiner* — Elvin G Enad
*Assistant Examiner* — Ronald Hinson
(74) *Attorney, Agent, or Firm* — Muncy, Geissler, Olds & Lowe, P.C.

(57) ABSTRACT

A power module includes a metal housing formed of a metal case and a metal cover plate, a transformer module accommodated in the metal housing, including a base member having an iron core holder block suspending in a center opening thereof and two connection blocks disposed at two opposite sides thereof, metal conducting terminals arranged in two sets and respectively mounted in the connection blocks of the base member, a winding wound round the iron core holder block, two iron cores respectively attached to opposing top and bottom sides of the iron core holder block and two circuit boards respectively inserted into the two connection blocks of the base member and electrically coupled with two opposing connection terminals of the winding and respective vertical contact ends of the metal conducting terminals, and a thermo-conductive insulating glue filled in the metal housing to package the transformer module.

6 Claims, 4 Drawing Sheets

POWER MODULE

BACKGROUND OF THE INVENTION

1. Field of the Invention

The present invention relates to power module technology and more particularly, to a power module, which uses a metal housing to house a transformer module that uses a base member to hold metal conducting terminals, a winding, two iron cores, an iron core binding tape and two circuit boards, shortening the power module assembling time and facilitating quick production of the power module.

2. Description of the Related Art

Following fast development of the modern technology, many different kinds of mechanical and electronic products have been created and widely used in our daily life and industry. Further, mechanical and electronic products commonly consume electricity to make mechanical power. Regular mechanical and electronic products are commonly equipped with a power supply device. In order to fit different application requirements, a power supply device for mechanical or electronic product generally has a power module adapted to regulate the power for the working of different component parts.

Further, it is the market trend to create products having keihaki tansho (light-thin-short-small) characteristics, and thus space occupation can be minimized. However, a power module releases much waste heat during operation, causing a heat dissipation problem. Reducing the size of a power module without lowering its capacity enhances concentration of heat source and makes the heat dissipation problem worse. When a power module works under a high temperature environment, the performance and reliability of the power module will be lowered, resulting in power loss. Further, shortening the distance among the component parts of a power module can lead to potential problems with electromagnetic interference (EMI). Therefore, it is desirable to provide a small-sized power module having excellent heat dissipation performance without causing EMI problems.

SUMMARY OF THE INVENTION

The present invention has been accomplished under the circumstances in view. It is therefore the main object of the present invention to provide a power module, which is small-sized, facilitating quick fabrication and delivery, achieving high performance, having long lifespan and eliminating EMI problems.

To achieve this and other objects of the present invention, a power module comprises a metal housing formed of a metal case and a metal cover plate, a transformer module mounted in the metal housing, and a thermo-conductive insulating glue filled in the metal housing to package the transformer module. The transformer module comprises a base member having an iron core holder block suspending in a center opening thereof and two connection blocks disposed at two opposite sides thereof, metal conducting terminals arranged in two sets and respectively mounted in the connection blocks of the base member, a winding wound round the iron core holder block of the base member, two iron cores respectively attached to opposing top and bottom sides of the iron core holder block of the base member, and two circuit boards respectively inserted into the two connection blocks of the base member and electrically coupled with two opposing connection terminals of the winding and respective vertical contact ends of the metal conducting terminals. Because the transformer module uses the base member to hold the metal conducting terminals, the winding, the iron cores, the binding tape and the circuit boards, the invention simplifies the assembly procedure of the power module.

Further, using the base member to hold the metal conducting terminals, winding, iron cores and circuit boards of the transformer module in the metal housing enables the internal space of the metal housing to be fully utilized and facilitates delivery of the power module. Further, the metal case and metal cover plate of the metal housing provide EMI protection to the transformer module.

Further, the thermo-conductive insulating glue fills up the inside space of the metal housing to package the transformer module, holding the transformer module tightly in the metal housing, protecting the transformer module against displacement and impact damage during delivery, and effectively transferring waste heat from the transformer module to the metal case and the metal cover plate for quick dissipation into the outside open air during operation of the power module, thereby prolonging the lifespan of the power module.

Further, each circuit board of the transformer module provides a wire-bonding circuit to substitute for transistors or ball grid arrays, saving the cost, eliminating any further pick-and-place or plug-in process, and preventing circuit board defects due to damage of one single transistor or ball grid array circuit component.

Further, after insertion of the circuit boards into respective insertion slots in the base member and electrical coupling of the circuit boards with two opposing connection terminals of the winding, spring leaves of each circuit board are elastically deformably stopped against one respective upright support wall at the base member, avoiding circuit board vibration or displacement.

DETAILED DESCRIPTION OF THE PREFERRED EMBODIMENT

Figure 1:
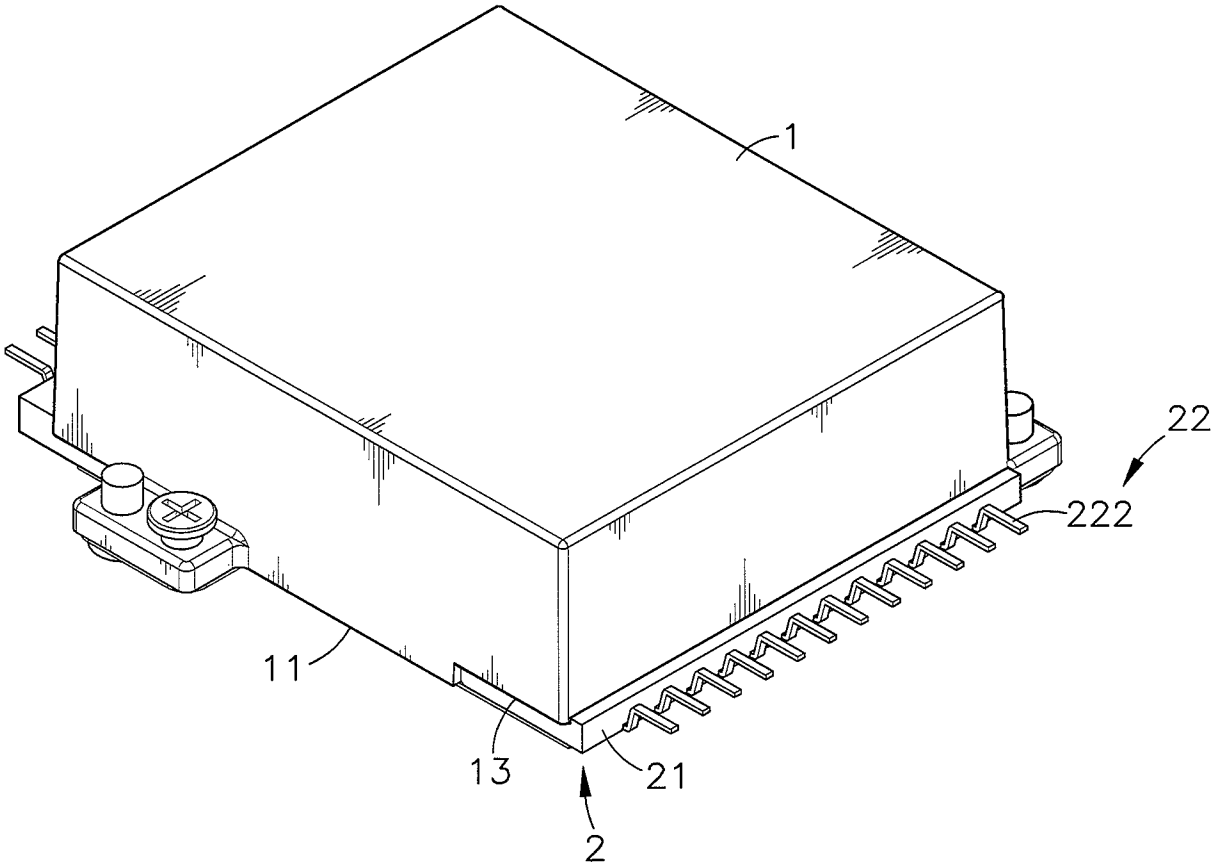
FIG. 1 is an oblique top elevational view of a power module in accordance with the present invention.
Figure 2:
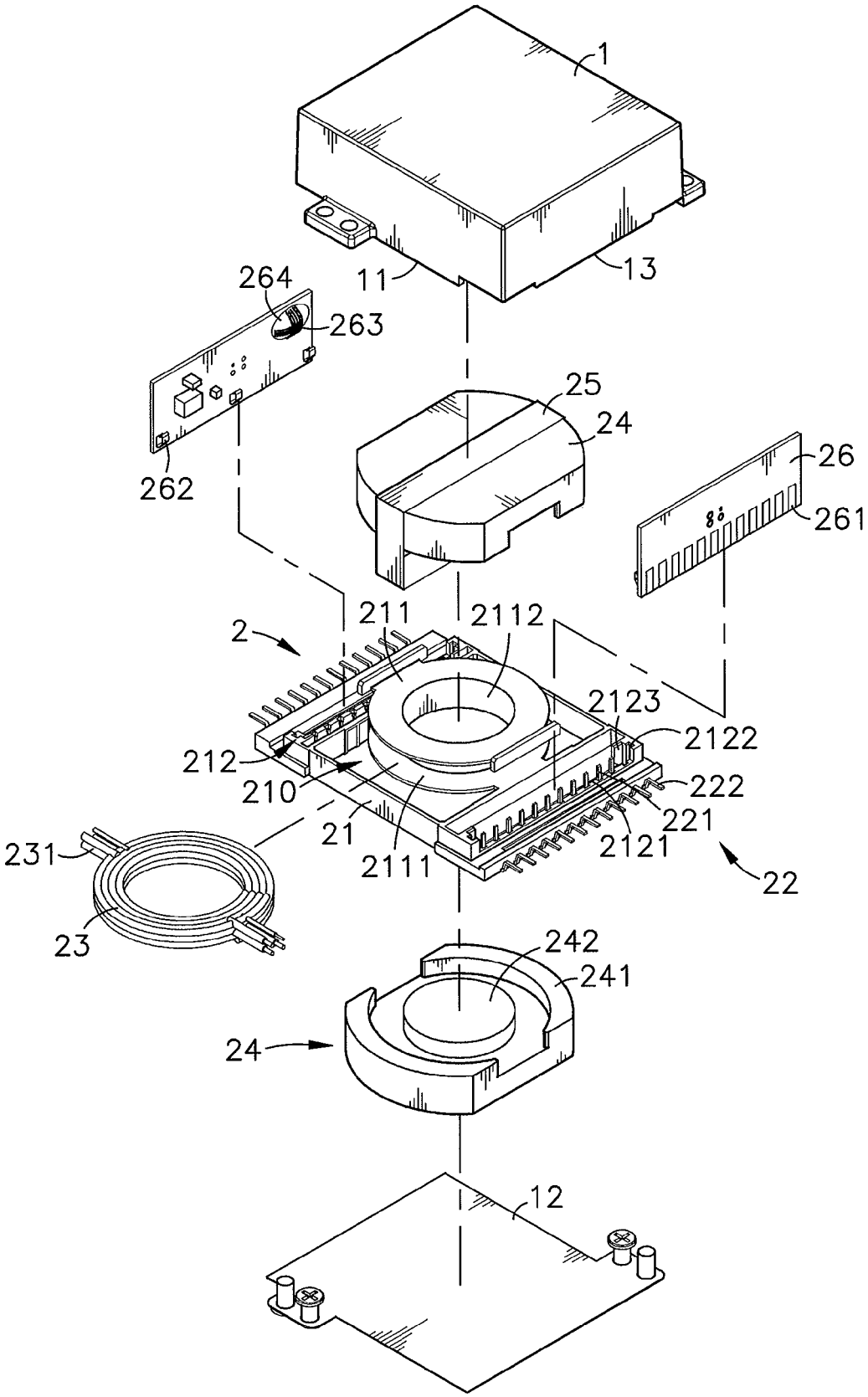
FIG. 2 is an exploded view of the power module in accordance with the present invention.
Figure 3:
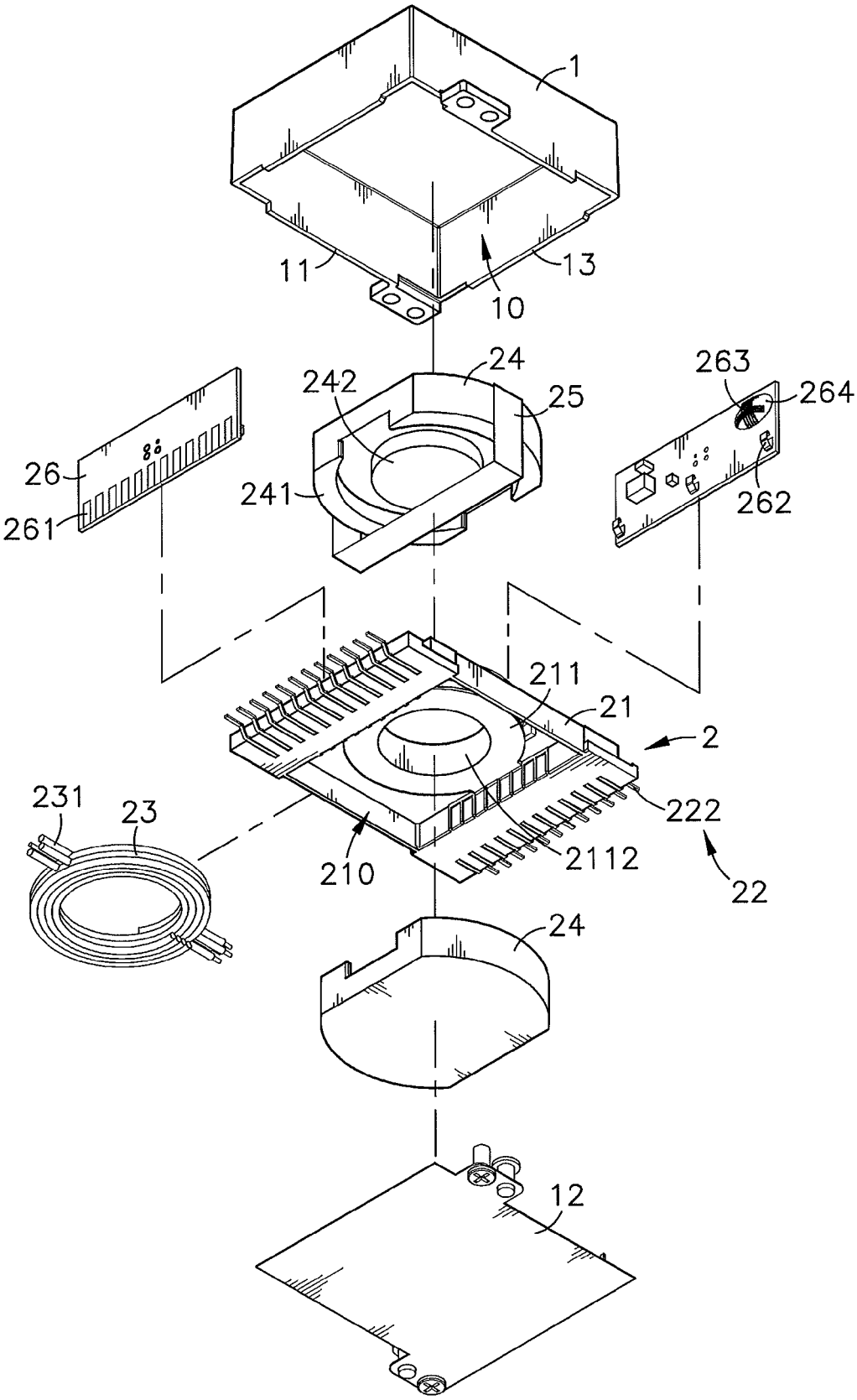
FIG. 3 corresponds to FIG. 2 when viewed from another angle.
Figure 4:
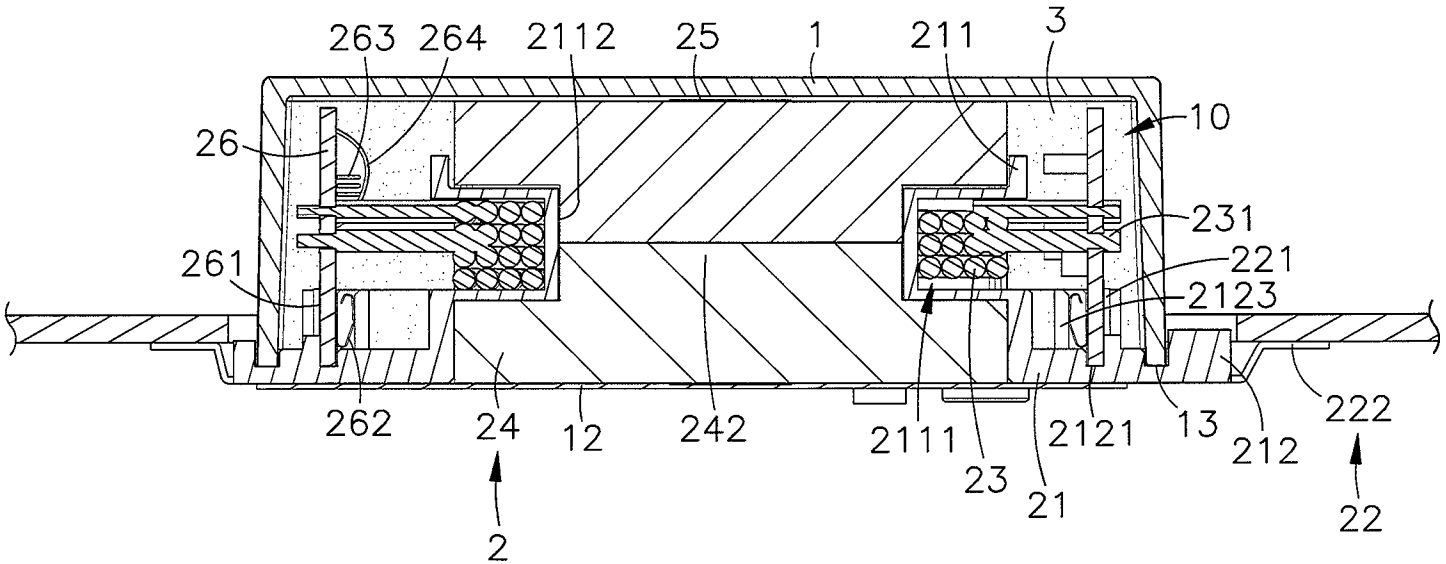
FIG. 4 is a sectional side view of the power module in accordance with the present invention.

Referring to FIGS. 1-4, a power module in accordance with the present invention is shown. The power module comprises a metal housing formed of a metal case 1 and a metal cover plate 12, a transformer module 2, and a thermo-conductive insulating glue 3.

The metal case 1 defines an accommodation chamber 10 and a bottom opening 11 in communication between the accommodation chamber 10 and the atmosphere. The metal cover plate 12 is affixed to the metal case 1 and covered on the bottom opening 11. After the metal case 1 and the metal cover plate 12 are affixed together, a plurality of insertion slots 13 are defined in between the metal case 1 and the metal cover plate 12 of the metal housing at two opposite sides of the bottom opening 11 of the metal case 1.

The transformer module 2 is accommodated in the accommodation chamber 10 in between the metal case 1 and the metal cover plate 12. The transformer module 2 comprises a base member 21, a plurality of metal conducting terminals 22, a winding 23, two iron cores 24, a binding tape 25, and two circuit boards 26. The base member 21 comprises a center opening 210, an iron core holder block 211 connected between two opposite side walls of the center opening 210 and suspending in the center opening 210, a winding groove 2111 extending around the periphery of the iron core holder block 211, a magnetic conducting passage 2112 vertically cut through opposing top and bottom sides of the iron core holder block 211, two connection blocks 212 disposed at two opposite sides thereof, an insertion slot 2121 defined in each connection block 212, two vertical guide grooves 2122 respectively upwardly extended from two distal ends of the insertion slot 2121 in each connection block 212, and an upright support wall 2123 defined in each connection block 212 and extending along one side of the associating insertion slot 2121 adjacent to the center opening 210 and spaced from the associating insertion slot 2121 at a predetermined distance. The metal conducting terminals 22 are arranged in two sets and respectively mounted in the two connection blocks 212 and respectively arranged along the associating insertion slots 2121 at an outer side opposite to the associating upright support walls 2123, each comprising a vertical contact end 221 vertically upwardly protruded over the top side of the associating connection block 212 and a horizontal mating end 222 horizontally outwardly extended out of the associating connection block 212 and one insertion slot 13 of the metal housing, which is formed of the metal case 1 and the metal cover plate 12. The winding 23 is mounted in the winding groove 2111 around the iron core holder block 211 of the base member 21, having two opposing connection terminals 231 respectively suspending above the insertion slots 2121 of the base member 21. The two iron cores 24 are respectively attached to opposing top and bottom sides of the iron core holder block 211 of the base member 21, each comprising a short center shaft 242 insertable into the magnetic conducting passage 2112 of the base member 21 and two opposing arched side flanges 241 attachable to the periphery of the iron core holder block 211 at two opposite lateral sides relative to the two opposing connection terminals 231 of the winding 23. The binding tape 25 is adapted to bind up the two iron cores 24. The two circuit boards 26 are respectively inserted into the insertion slots 2121 of the base member 21 and electrically coupled with the two opposing connection terminals 231 of the winding 23, each comprising a plurality of metal contacts 261 respectively kept in positive contact with the vertical contact ends 221 of the metal conducting terminals 22 in the associating connection block 212 of the base member 21, a plurality of spring leaves 262 respectively elastically deformably stopped against the upright support wall 2123 at the associating connection block 212 of the base member 21, a wire-bonding circuit 263, a protective adhesive 264 covering the wire-bonding circuit 263, and other requisite components, including power semiconductor devices, control ICs, drivers, inductors, capacitors, resistors, and/or passive devices.

The thermo-conductive insulating glue 3 is filled through the bottom opening 11 into the accommodation chamber 10 of the metal case 1 to fill up the inside space of the metal case 1 beyond the transformer module 2.

When assembling the power module, mount the winding 23 in the winding groove 2111 around the iron core holder block 211 of the base member 21 to have the two opposing connection terminals 231 of the winding 23 be pulled out of the winding groove 2111 at two opposite sides relative to the iron core holder block 211, attach the two iron cores 24 to the opposing top and bottom sides of the iron core holder block 211 of the base member 21, bind up the two iron cores 24 with the binding tape 25, insert the two circuit boards 26 through the respective vertical guide grooves 2122 into the respective insertion slots 2121 of the base member 21 to keep the metal contacts 261 of the two circuit boards 26 in positive contact with the vertical contact ends 221 of the metal conducting terminals 22, electrically couple the two opposing connection terminals 231 of the winding 23 to the two circuit boards 26 respectively, attach the metal case 1 onto the transformer module 2, affix the metal cover plate 12 to the metal case 1 to let the horizontal mating ends 222 of the metal conducting terminals 22 extend out of the corresponding insertion slots 13 of the metal housing that is formed of the metal case 1 and the metal cover plate 12. Thereafter, fill the thermo-conductive insulating glue 3 in liquid form into the accommodation chamber 10 of the metal case 1 to surround the transformer module 2. After the applied thermo-conductive insulating glue 3 is cured, it holds the transformer module 2 tightly in the metal case 1. Thus, the power module is assembled. Because the transformer module 2 uses the base member 21 to hold the other component parts, i.e., the metal conducting terminals 22, the winding 23, the iron cores 24, the binding tape 25 and the circuit boards 26, and the transformer module 2 is then mounted in the accommodation chamber 10 of the metal housing formed of the metal case 1 and the metal cover plate 12, the invention simplifies the assembly procedure of the power module, shortens power module assembling time, and speed up power module production.

According to the present preferred embodiment, the metal case 1 and the metal cover plate 12 are fastened together to hold the transformer module 2 therein, allowing the horizontal mating ends 222 of the metal conducting terminals 22 to be extended out of the corresponding insertion slots 13. Alternatively, the metal case 1 and metal cover plate 12 of the metal housing can be configured to hold the transformer module 2 therein, allowing the two connection blocks 212 of the base member 21 to be extended out of the corresponding insertion slots 13 to hold the horizontal mating ends 222 of the metal conducting terminals 22 outside the metal case 1 and the metal cover plate 12.

Further, using the base member 21 to hold the metal conducting terminals 22, winding 23, iron cores 24, binding tape 25 and circuit boards 26 of the transformer module 2 in the accommodation chamber 10 enables the internal space of the accommodation chamber 10 to be fully utilized, and therefore the power module of the present invention has space saving and small size characteristics.

Further, the thermo-conductive insulating glue 3 fills up the inside space of the accommodation chamber 10 of the metal case 1 to surround the transformer module 2, holding the transformer module 2 tightly in the metal case 1, protecting the transformer module 2 against displacement and impact damage during delivery, and achieving an insulating effect. Further, during operation of the transformer module 2, the thermo-conductive insulating glue 3 can transfer waste heat released by the transformer module 2 to the metal case 1 and the metal cover plate 12 for quick dissipation into the outside open air through convection or radiation to lower the ambient temperature so that the transformer module 2 can work normally, prolonging the lifespan.

Further, because the transformer module 2 is accommodated in the accommodation chamber 10 of the metal case 1 and the bottom opening 11 of the metal case 1 is covered by the metal cover plate 12, the metal case 1 and the metal cover plate 12 well protect the transformer module 2 against electromagnetic interference, i.e., the invention provides protection against EMI. Further, each circuit board 26 of the transformer module 2 provides a wire-bonding circuit 263 to substitute for transistors or ball grid arrays, saving the cost. Due to the design of the wire-bonding circuit 263, no pick-and-place or plug-in process will be needed, preventing circuit board defects due to damage of one single transistor or ball grid array circuit component. Therefore, the invention greatly improves the product yield.

Referring to FIGS. 1-4 again, subject to the design of the insertion slot 2121, two vertical guide grooves 2122 and an upright support wall 2123 at each of the two connection blocks 212 of the base member 21, the two circuit boards 26 can be respectively and smoothly inserted through the respective vertical guide grooves 2122 into the respective insertion slots 2121 of the base member 21 and electrically coupled with the two opposing connection terminals 231 of the winding 23. To avoid vibration of the circuit boards 26 relative to the base member 21, each circuit board 26 provides a plurality of spring leaves 262 respectively elastically deformably stopped against the upright support wall 2123 at the associating connection block 212 of the base member 21. It is to be noted that the shape, number and location of the spring leaves 262 of each circuit board 26 shown in the drawings are not intended to restrict the invention. Any other equivalent changes can be made thereunto.

In actual application, the power module of the present invention has the advantages and features as follows:

1. Because the transformer module 2 uses the base member 21 to hold the metal conducting terminals 22, the winding 23, the iron cores 24, the binding tape 25 and the circuit boards 26, and because the whole assembly of the transformer module 2 is mounted in the accommodation chamber 10 in between the metal case 1 and the metal cover plate 12, the invention simplifies the assembly procedure of the power module.
2. By using the base member 21 to hold the metal conducting terminals 22, winding 23, iron cores 24, binding tape 25 and circuit boards 26 of the transformer module 2 in the accommodation chamber 10, the invention enables the internal space of the accommodation chamber 10 to be fully utilized.
3. The metal case 1 and the metal cover plate 12 are fastened together to hold the transformer module 2 therein, facilitating delivery and providing EMI protection.
4. The thermo-conductive insulating glue 3 fills up the inside space of the accommodation chamber 10 of the metal case 1 to surround the transformer module 2, holding the transformer module 2 tightly in the metal case 1, protecting the transformer module 2 against displacement and impact damage during delivery, and effectively transferring waste heat from the transformer module 2 to the metal case 1 and the metal cover plate 12 for quick dissipation into the outside open air.
5. Each circuit board 26 of the transformer module 2 provides a wire-bonding circuit 263 to substitute for transistors or ball grid arrays, saving the cost, eliminating any further pick-and-place or plug-in process, and preventing circuit board defects due to damage of one single transistor or ball grid array circuit component.
6. After insertion of the circuit boards 26 through the respective vertical guide grooves 2122 into the respective insertion slots 2121 of the base member 21 and electrical coupling of the circuit boards 26 with the two opposing connection terminals 231 of the winding 23, the spring leaves 262 of each circuit board 26 are elastically deformably stopped against the upright support wall 2123 at the associating connection block 212 of the base member 21, avoiding circuit board vibration or displacement.

In conclusion, the invention provides a power module, which comprises a metal housing formed of a metal case and a metal cover plate, a transformer module accommodated in the metal housing, and a thermo-conductive insulating glue filled up the inside space of the metal housing to package the transformer module. The transformer module comprises a base member, which comprises a center opening, an iron core holder block suspending in the center opening, a winding groove extending around the periphery of the iron core holder block, two connection blocks disposed at two opposite sides relative to the iron core holder block and an insertion slot defined in each connection block, a plurality of metal conducting terminals arranged in two sets and respectively mounted in the two connection blocks along the associating insertion slots, a winding mounted in the winding groove around the iron core holder block of the base member, two iron cores respectively attached to opposing top and bottom sides of the iron core holder block of the base member, a binding tape binding up the two iron cores, and two circuit boards respectively inserted into the insertion slots of the base member and electrically coupled with two opposing connection terminals of the winding with respective metal contacts thereof respectively kept in positive contact with vertical contact ends of the metal conducting terminals.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A power module, comprising:

a metal housing comprising a metal case and a metal cover plate covering said metal case, said metal case defining an accommodation chamber therein and a bottom opening in communication between said accommodation chamber and the surrounding, said metal cover plate being affixed to said metal case to cover said bottom opening and defining with said metal case, a plurality of insertion slots at two opposite sides of said bottom opening;

a transformer module accommodated in said accommodation chamber inside said metal housing, said transformer module comprising a base member, said base member comprising a center opening, an iron core holder block connected between two opposite side walls of said center opening and suspending in said center opening, a winding groove extending around the periphery of said iron core holder block, two connection blocks disposed at two opposite sides thereof, an insertion slot defined in each said connection block, a plurality of metal conducting terminals arranged in two sets and respectively mounted in said two connection blocks of said base member and along the respective said insertion slots, each said metal conducting terminal comprising a vertical contact end vertically upwardly protruded over a top side of said connection block and a horizontal mating end horizontally outwardly extended out of said connection block and one said insertion slot of said metal housing, a winding mounted in said winding groove around said iron core holder block of said base member, said winding comprising two opposing connection terminals respectively suspending above said insertion slots of said base member, two iron cores respectively attached to opposing top and bottom sides of said iron core holder block of said base member, and two circuit boards respectively inserted into said insertion slots of said base member and electrically coupled with said two opposing connection terminals of said winding, each said circuit board comprising a plurality of metal contacts respectively kept in positive contact with the vertical contact ends of the metal conducting terminals in the associating said connection block of said base member; and a thermo-conductive insulating glue filled in said accommodation chamber of said metal case to package said transformer module.

2. The power module as claimed in claim 1, wherein said base member of said transformer comprises a magnetic conducting passage vertically cut through opposing top and bottom sides of said iron core holder block; each said iron core comprises a short center shaft inserted into said magnetic conducting passage in said base member, and two opposing arched side flanges attached to the periphery of said iron core holder block at two opposite lateral sides relative to said two opposing connection terminals of said winding.

3. The power module as claimed in claim 2, wherein said transformer module further comprises a binding tape fastened to said two iron cores to bind up said two iron cores.

4. The power module as claimed in claim 1, wherein said base member of said transformer module further comprises two vertical guide grooves respectively upwardly extended from two distal ends of the insertion slot in each said connection block, and an upright support wall defined in each said connection block and extending along one side of said insertion slot adjacent to said center opening and spaced from the associating said insertion slot at a predetermined distance; each said circuit board further comprises a plurality of spring leaves respectively elastically deformably stopped against the upright support wall at the associating said connection block of said base member.

5. The power module as claimed in claim 1, wherein each said circuit board further comprises a wire-bonding circuit, and a protective adhesive covering said wire-bonding circuit for protection.

6. The power module as claimed in claim 1, wherein each said circuit board further comprises at least one power semiconductor device, at least one control IC, at least one driver, at least one inductor, at least one capacitor and/or at least one resistor.

* * * * *